US005266230A

United States Patent [19]

Tomizawa et al.

[11] Patent Number: 5,266,230

[45] Date of Patent: Nov. 30, 1993

[54] ELECTROVISCOUS FLUID CONTAINING ANTIOXIDANT AND/OR CORROSION INHIBITOR

[75] Inventors: Hirotaka Tomizawa; Makoto Kanbara; Masahiko Hayafune, all of Saitama, Japan

[73] Assignee: Tonen Corporation, Tokyo, Japan

[21] Appl. No.: 790,089

[22] Filed: Nov. 13, 1991

Related U.S. Application Data

[63] Continuation of Ser. No. 514,632, Apr. 25, 1990, abandoned.

[30] Foreign Application Priority Data

Apr. 26, 1989 [JP] Japan ..... 1-106997

[51] Int. Cl.[5] ..... C10M 171/00; C10M 169/04

[52] U.S. Cl. ..... 252/73; 252/74; 252/75; 252/77; 252/572

[58] Field of Search ..... 252/73, 74, 75, 77, 252/572

[56] References Cited

U.S. PATENT DOCUMENTS

| | | | |
|---|---|---|---|
| 3,047,507 | 7/1962 | Winslow | 252/75 |
| 3,367,872 | 2/1968 | Martinek et al. | 252/74 |
| 3,639,275 | 2/1972 | Stayner | 252/572 |
| 3,970,573 | 7/1976 | Westhaver | 252/73 |
| 4,276,184 | 6/1981 | Mandelcorn et al. | 252/579 |
| 4,293,433 | 10/1981 | Borror et al. | 252/575 |
| 4,482,478 | 11/1984 | Shaw | 252/579 |
| 4,679,119 | 7/1987 | Shedigan | 252/579 |
| 4,687,589 | 8/1987 | Block et al. | 252/572 |
| 4,744,914 | 5/1988 | Filisko et al. | 252/572 |
| 5,075,023 | 12/1991 | Fukuyama et al. | 252/74 |

FOREIGN PATENT DOCUMENTS

| | | |
|---|---|---|
| 63-97694 | 4/1988 | Japan . |
| 1076754 | 7/1967 | United Kingdom . |

OTHER PUBLICATIONS

Matsepuro, "Structure Formation in an Electric Field and the Composition of Electrorheological Suspension", translated from Elektroreol. Issleo Pril, Minsk, pp. 27–51, 1981.

*Primary Examiner*—Christine Skane

*Attorney, Agent, or Firm*—Armstrong, Westerman, Hattori, McLeland & Naughton

[57] ABSTRACT

In an electroviscous fluid comprising electrically insulating fluid as the dispersant and porous solid particles as the dispersed phase, at lease one substance selected from acid, salt and base and at least one substance selected from polyhydric alcohol and water, and further containing dispersing agent, antioxidant and/or corrosion inhibitor are added to obtain the better effects such as high responsiveness in wide temperature range up to high temperature, high reproducibility, excellent electroviscous effect and the higher durability.

Therefore, the electroviscous fluid by this invention is useful, for example, for the control systems utilizing viscosity change, and it is capable to increase the control accuracy, particularly in the operation at high temperature.

4 Claims, No Drawings

ELECTROVISCOUS FLUID CONTAINING ANTIOXIDANT AND/OR CORROSION INHIBITOR

This application is a continuation application Ser. No. 514,632 filed Apr. 25, 1990 now abandoned.

BACKGROUND OF THE INVENTION

The present invention relates to an electroviscous fluid, the viscosity of which can be controlled by applying voltage, and in particular to an electroviscous fluid, in which viscosity is changed rapidly and reversibly from low temperature range to high temperature range when voltage is applied and long and stable electroviscous effect is obtained and which can be used for electrical control of mechanical devices such as clutch, valve, shock absorber, etc.

Electro-rheological fluid or electroviscous fluid, in which viscosity of the fluid is changeable by the application of voltage, has been known since many years ago (Duff, A. W., Physical Review, Vol. 4, No. 1 (1896) 23). Early studies on electroviscous fluid were concentrated on the system containing liquid only, and the effect was not strong enough. Later, studies have been made on the electroviscous fluid of solid disperse system, where considerable electroviscous effect could be obtained.

For example, Winslow proposed an electroviscous fluid, using paraffin, silica gel powder and adding water to make the system slightly electroconductive (Winslow, W. M., J. of Applied Physics, Vol. 20 (1949) 1137). From this study by Winslow, the electroviscous (electro-rheological) effect of the electroviscous fluid is called ER effect or Winslow effect.

On the other hand, study has also been made on the mechanism of electroviscous effect (ER effect) in the electroviscous fluid. For example, Klass reported that each particle, i.e. the dispersed phase in electroviscous fluid, generates the induced polarization of the double layer in electrical field and this was the primary cause of such effect (Klass, D. L., et al., J. of Applied Physics, Vol. 38, No. 1 (1967) 67). If this is explained from the principle of the electric double layer, the ions adsorbed on the dispersed solids (such as silica gel) are evenly arranged on outer surface of dispersed solids when E (electric field)=0, while polarization occurs in the ion distribution when E (electric field)=finite value and each particle exerts electrostatic action on each other in electric field. Thus, each particle forms bridge (cross-linkage) between electrodes and the shear-resistant force to the external stress, i.e., ER effect.

With full consideration given on the mechanism of ER effect in the electroviscous fluid of this solid dispersing system, various proposals have been made to increase and to stabilize the viscosity of electroviscous fluid. For example, a proposal was made to use silicon dioxide type fine particles, on which ferroelectric powder and small quantity of water are adsorbed (Japanese Provisional Patent Publication 53-17585), whereas this is disadvantageous and unsatisfactory in various points such as the response, the reproducibility of ER effect, low electroviscous effect, the stability of ER effect for a long time, etc. Particularly, the conventional electroviscous fluid containing moisture is disadvantageous in that water is evaporated at high temperature of more than 80° C. Further, even at less than 80° C., there are also the problems such as the unstability by the migration of moisture on the surface of the particles, the problem of durability by elution of electrode metal (such as copper) when high electric field is applied, the enhancement of ionization by temperature increase and the increase of electric current, or unstable temperature property, and other problems caused by the presence of moisture.

It is an object of this invention to offer an electroviscous fluid, by which it is possible to maintain ER effect stably up to high temperature of 100° C. and to achive high durability.

SUMMARY OF THE INVENTION

The electroviscous fluid according to this invention consists of electrically insulating fluid, porous solid particles, at least one substance selected from acid, salt and base and at least one substance selected from polyhydric alcohol and water, and is characterized in that it contains antioxidant and corrosion inhibitor.

When polyhydric alcohol, and acid, salt or base is added to the electroviscous fluid containing electrically insulating fluid and porous solid particles, electroviscous effect is stabilized in wide temperature range up to high temperature, and high electroviscous effect is obtained, However, there is the problem in the durability because of the oxidation of electrically insulating fluid, porous solid particles, polyhydric alcohol, etc. or the increase of electrically conductive substance caused by the corrosion of electrode under high voltage.

According to the present invention, antioxidant and/or corrosion inhibitor are added to the electroviscous fluid to obtain the better effects in the responsiveness of viscosity change in wide temperature range up to high temperature, reproducibility, electroviscous effect and, especially, the durability.

DESCRIPTION OF THE PREFERRED EMBODIMENTS

Description is given on each component of the electroviscous fluid according to the present invention.

First, as the electrically insulating fluid, which is a dispersion medium in the electroviscous fluid, for example, mineral oil and synthetic lubricant oil can be used.

More concretely, there are oils such as paraffinic oil, naphthenic oil, poly-α-olefin, polyalkyleneglycol, silicone oil, diester, polyolester, phosphoric acid ester, silicon compound, fluorine compound, polyphenylether, etc. The electroviscous fluid having the viscosity of 5-300 cP at 40° C. can be used.

As the porous solid particles, for example, silica gel, moisture-containing resin, diatomaceous earth, alumina, silica-alumina, zeolite, ion exchange resin, cellulose, etc. can be used. The porous solid particles having particle size of 10 nm-200 μm are used at the ratio of 0.1-50 wt %. If it is less than 0.1 wt %, ER effect is too low. If it exceeds 50 wt %, the dispersing property is decreased.

Dispersing agent may be used in the electroviscous fluid by this invention in order to disperse porous solid particles evenly and stably.

As the dispersing agents, for example, sulfonates, phenates, phosphonates, succinic acid imides, amines, non-ionic dispersing agents, etc. are used.

More concretely, there are magnesium sulfonate, calcium sulfonate, calcium phosphonate, polybutenyl succinic acid imide, sorbitan mono-oleate, sorbitan sesqui-oleate, etc. These are normally used at the ratio of 0.1-10 wt %, while they may not be used if porous solid particles have high dispersing property.

Polyhydric alcohol components, and acid, salt or base components may be used alone to obtain the higher ER effect. Polyhydric alcohol components keep ER effect at high temperature, while acid, salt or base components can increase the polarization effect. By using these components simultaneously, it is possible to increase ER effect at high temperature.

As the polyhydric alcohol, dihydric alcohol and trihydric alcohol are effective. It is preferable to use ethyleneglycol, glycerin, propanediol, butanediol, hexanediol, etc. and to use these substance at the ratio of 1-30 wt % to porous solid particles, and more preferably at 2-15 wt %. If it is less than 1 wt %, ER effect is too low. If it exceeds 30 wt %, it is undesirable because current flows more easily.

As the acid components, inorganic acids such as sulfuric acid, hydrochloric acid, nitric acid, perchloric acid, chromic acid, phosphoric acid, boric acid, etc. or organic acids such as acetic acid, formic acid, propionic acid, lactic acid, isolactic acid, valeric acid, oxalic acid, malonic acid, etc. are used.

As the salts, any compound consisting of metal or base radical (such as $NH_4^+$, $N_2H_5^+$) and acid radical can be used. Particularly, it is preferable to use the substance which is dissolved in polyhydric alcohol or mixture of polyhydric alcohol and water and is dissociated, or typical ionic crystal such as halogenated compound of alkali metal or alkali earth metal, or the alkali salt of organic acid.

More concretely, there are LiCl, NaCl, KCl, $MgCl_2$, $CaCl_2$, $BaCl_2$, LiBr, NaBr, KBr, $MgBr_2$, LiI, NaI, KI, $AgNO_3$, $Ca(NO_3)_2$, $NaNO_2$, $NH_4NO_3$, $K_2SO_4$, $Na_2SO_4$, $NaHSO_4$, $(NH_4)_2SO_4$ or alkali salt of acid such as formic acid, acetic acid, oxalic acid, succinic acid, etc.

The base to be used in the present invention includes hydroxides of alkali earth metal, carbonates of alkali metal, amines, etc. It is preferable to use the substance, which is dissolved in polyhydric alcohol or in the mixture of polyhydric alcohol and water and is dissociated. As the base of this type, there are NaOH, KOH, $Ca(OH)_2$, $Na_2CO_3$, $NaHCO_3$, $K_3PO_4$, $Na_3PO_4$, aniline, alkylamine, ethanolamine, etc. The salt and the base as described above may be used simultaneously.

Acid, salt and base may be used at the ratio of 0.01-5 wt % to the entire electroviscous fluid. If it is less than 0.01 wt %, ER effect is too low. If it exceeds 5 wt %, it is not desirable because electric current flows more easily and electric power consumption increase.

The present invention is characterized in that antioxidant and/or corrosion inhibitor is added to the electroviscous fluid.

Antioxidant is added to prevent the oxidation of electrically insulating liquid and polyhydric alcohol and also to stop the increase of electric conductivity due to oxidation products. Corrosion inhibitor is added to prevent the increase of electric conductivity caused by the generation of metallic ions due to the corrosion of electrode (such as copper) under high voltage.

The antioxidants inactive to polarizing agent and porous solid particles may be used. Phenol type or amine type antioxidants can be used. As phenol type antioxidants, there are 2,6-di-t-butylparacresol, 4,4'-methylenebis (2,6-di-t-butylphenol), 2,6-di-t-butylphenol, etc. As amine type antioxidants, there are dioctyldiphenylamine, phenyl-α-naphthylamine, alkyldiphenylamine, N-nitrodiphenylamine, etc. Preferably, 2,6-di-t-butylparacresol or dioctyldiphenylamine can be used. These substances can be used at the ratio of 0.01-10 wt % to the entire electroviscous fluid, and more preferably at 0.1-2.0 wt %. If it is less than 0.01 wt %, antioxidant effect is too low. If it exceeds 10 wt %, the problems occur such as color tone deterioration, increased turbidity, generation of sludge, increase of viscosity, etc.

It is preferable to use corrosion inhibitor, which is inactive to polarizing agent and porous solid particles. More concretely, nitrogen compounds such as benzotriazole and its derivatives, imidazoline, pyrimidine derivative, etc., and the compounds containing sulfur and nitrogen, such as 1,3,4-thiadiazolepolysulfide, 1,3,4-thiadiazolil-2,5-bisdialkyldithiocarbamate, 2-(alkyldithio)benzoimidazole, etc. or β-(o-carboxybenzylthio) propionnitrile or propionic acid, etc. may be used, and more preferably, benzotriazole and its derivatives can be used. It is preferable to use these substances at the ratio of 0.001-10 wt % to the entire electroviscous fluid, and more preferably, at 0.01-1.0 wt %. If it is less than 0.001 wt %, there is no corrosion inhibition effect. If it exceeds 10 wt %, the problems occur such as color tone deterioration, increased turbidity, generation of sludge, and increase of consistency.

It is naturally possible to use water in such degree as not to reduce ER effect in the electroviscous fluid system of this invention.

In the following, the features of the invention is described in connection with the embodiments, whereas this invention is not limited to these embodiments.

EMBODIMENTS 1-8

Comparative Example

| (Preparation of electroviscous fluid) | |
|---|---|
| Mineral oil | 89.1% |
| Silica gel | 6% |
| Ethyleneglycol | 0.4% |
| Acetic acid | 0.5% |
| Succinic acid imide | 4% |
| | (Unit: Weight %) |

The above substances are mixed together and are used.

Using this mixture fluid, various types of electroviscous fluids having the compositions as given in Table 1 below have been prepared.

TABLE 1

| (Unit: Weight %) | |
|---|---|
| Embodiment 1 | Fluid:Antioxidant (A) = 99.7:0.3 |
| Embodiment 2 | Fluid:Corrosion inhibitor (a) = 99.9:0.1 |
| Embodiment 3 | Fluid:Antioxidant (A):Corrosion inhibitor (a) = 99.6:0.3:0.1 |
| Embodiment 4 | Fluid:Antioxidant (B):Corrosion inhibitor (b) = 99.6:0.3:0.1 |
| Embodiment 5 | Fluid:Antioxidant (A):Corrosion inhibitor (a) = 97.9:2.0:0.1 |
| Embodiment 6 | Fluid:Antioxidant (A):Corrosion inhibitor (a) = 96.9:3.0:0.1 |
| Embodiment 7 | Fluid:Antioxidant (A):Corrosion inhibitor (a) = 98.5:0.5:1.0 |
| Embodiment 8 | Fluid:Antioxidant (A):Corrosion inhibitor (a) = 97.5:0.5:2.0 |
| Comparative example | Fluid only |

The viscosity of mineral oil was adjusted in such manner that all of these samples have the viscosity of 80 cP at 40° C.

In the above table, 2,6-di-t-butylphenol was used as the antioxidant (A), dioctyldiphenylamine was used as (B). Benzotriazole derivative was used as the corrosion inhibitor (a) and imidazole was used as corrosion inhibitor (b).

Operating conditions and evaluation items for electroviscous fluid

With the above electroviscous fluids at 40° C. and 90° C., the following parameters were measured using a voltage-applicable rotation viscosimeter:

Responsiveness:

Evaluated by the time (second) until viscosity is stabilized when AC electric field is changed from 0 to $2\times10^6$ (V/m).

Reproducibility:

Evaluated by the ratio of viscosity change at the electric field of $2\times10^6$ (V/m) when AC electric field is repeatedly changed by the cycle of $0\rightarrow2\times10^6$ (V/m)$\rightarrow0$.

Durability:

Evaluated by the variation (%) of the viscosity over time when AC electric field is stabilized at $2\times10^6$ (V/m). (Measuring time: 5 hours)

Electroviscous effect:

Evaluated by the ratio of the viscosity at a AC electric field of $2\times10^6$ (V/m) to the viscosity at an electric field of 0 (V/m).

The results of the evaluation are summarized in Table 2.

TABLE 2

| | Responsiveness (sec.) | Reproducibility (%) | Durability (%) | Electroviscous effect (ratio) |
|---|---|---|---|---|
| Embodiment 1 | | | | |
| 40° C. | 1 or less | ±2 | 100 | 5 |
| 90° C. | 1 or less | ±2 | 96 | 7 |
| Embodiment 2 | | | | |
| 40° C. | 1 or less | ±2 | 100 | 5 |
| 90° C. | 1 or less | ±2 | 95 | 7 |
| Embodiment 3 | | | | |
| 40° C. | 1 or less | ±2 | 100 | 5 |
| 90° C. | 1 or less | ±2 | 98 | 7 |
| Embodiment 4 | | | | |
| 40° C. | 1 or less | ±2 | 100 | 5 |
| 90° C. | 1 or less | ±2 | 97 | 7 |
| Embodiment 5 | | | | |
| 40° C. | 1 or less | ±2 | 100 | 5 |
| 90° C. | 1 or less | ±2 | 98 | 8 |
| Embodiment 6 | | | | |
| 40° C. | 1 or less | ±2 | 100 | 5 |
| 90° C. | 1 or less | ±2 | 94 | 7 |
| Embodiment 7 | | | | |
| 40° C. | 1 or less | ±2 | 100 | 5 |
| 90° C. | 1 or less | ±2 | 98 | 8 |
| Embodiment 8 | | | | |
| 40° C. | 1 or less | ±2 | 100 | 4 |
| 90° C. | 1 or less | ±2 | 93 | 7 |
| Comparative example | | | | |
| 40° C. | 1 or less | ±2 | 100 | 5 |
| 90° C. | 1 or less | ±2 | 90 | 7 |

As it is evident from Table 2, when antioxidant and/or corrosion inhibitor is added to electroviscous fluid, excellent effects can be obtained such as responsiveness of viscosity change in wide temperature range up to high temperature, reproducibility, electroviscous effect and the durability.

What we claim is:

1. An electroviscous fluid in which no moisture is contained, comprising an electrically insulating fluid with viscosity of 5 to 300 cp at 40° C. as a dispersion medium, and dispersed therein:

(a) 0.1 to 50 weight % of porous solid particles;

(b) 1 to 30 weight %, based on the porous solid particles, of at least one polyhydric alcohol selected from the group consisting of ethylene glycol, triethylene glycol, glycerine, propanediol, butanediol, and hexanediol; and (c) 0.01 to 10 weight % of at least one antioxidant selected from the group consisting of 2,6-di-t-butylparacresol, 4,4'-methylene-bis-(2,6-di-t-butylphenol), 2,6-di-t-butylphenol, dioctyldiphenylamine, phenyl-α-naphthylamine, alkyldiphenylamine, and N-nitrodiphenylamine and/or 0.001 to 10 weight % of at least one corrosion inhibitor selected from the group consisting of benzotriazole, imidazoline, pyrimidine derivative, 1,3,4-thiadiazole polysulfide, 1,3,4-thiadiazorile-2,5-bis-dialkyl dithiocarbamate, 2-(alkyldithio)-benzoimidazole, β-(o-carboxybenzylthio)-propionnitrile and propionic acid.

2. An electroviscous fluid in which no moisture is contained, comprising an electrically insulating fluid with viscosity of 5 to 300 cp at 40° C. as a dispersion medium, and dispersed therein:

(a) 0.1 to 50 weight % of porous solid particles;

(b) 1 to 30 weight %, based on the porous solid particles, of at least one polyhydric alcohol selected from the group consisting of ethylene glycol, triethylene glycol, glycerine, propanediol, butanediol, and hexanediol;

(c) 0.1 to 10 weight % of at least one dispersing agent selected from the group consisting of magnesium, calcium sulfonate, calcium phosphonate, polybutenyl succinimide, and sorbitan monooleate; and (d) 0.1 to 10 weight % of at least one antioxidant selected from the group consisting of 2,6-di-t-butylparacresol, 4,4'-methylene-bis-(2,6-di-t-butylphenol), 2,6-di-t-butylphenol, dioctyldiphenylamine, phenyl-α-naphthylamine, alkyldiphenylamine, and N-nitrodiphenylamine and/or 0.001 to 10 weight % of at least one corrosion inhibitor selected from the group consisting of benzotriazole, imidazoline, pyrimidine derivative, 1,3,4-thiadiazole polysulfide, 1,3,4-thiadiazorile-2,5-bis-dialkyl dithiocarbamate, 2-(alkyldithio)-benzoimidazole, β-(o-carboxybenzylthio)-propionnitrile and propionic acid.

3. An electroviscous fluid in which no moisture is contained, comprising electrically insulating fluid with viscosity of 5 to 300 cp at 40° C. as a dispersion medium, and dispersed therein;

(a) 0.1 to 50 weight % of porous solid particles;

(b) 1 to 30 weight %, based on the porous solid particles, of at least one polyhydric alcohol selected from the group consisting of ethylene glycol, triethylene glycol, glycerine, propanediol, butanediol, and hexanediol;

(c) 0.01 to 5 weight % of at least one substance selected from the group consisting of sulfuric acid, hydrochloric acid, nitric acid, perchloric acid, chromic acid, phosphoric acid, boric acid, acetic acid, formic acid, propionic acid, lactic acid, isolactic acid, valeric acid, oxalic acid, malonic acid, lithium chloride, sodium chloride, potassium chloride, magnesium chloride, calcium chloride, barium chloride, lithium bromide, sodium bromide, potassium bromide, magnesium bromide, lithium iodide, sodium iodide, potassium iodide, silver nitrate, calcium nitrate, sodium nitrite, ammonium nitrate, potassium sulfate, sodium sulfate, sodium hydrogensulfate, ammonium sulfate, formic acid salt, acetic acid salt, oxalic acid salt, succinic acid salt, sodium hydroxide, potassium hydroxide, calcium hydroxide, sodium carbonate, sodium hydrogencarbonate, potassium phosphate, aniline, alkylamine, and ethanolamine; and (d) 0.1 to 10 weight % of at least one antioxidant selected from the group consisting of 2,6-di-t-butylparacresol, 4,4'-methylene-bis-(2,6-di-t-butylphenol), 2,6-di-t-butylphenol, dioctyldiphenylamine, phenyl-α-naphthylamine, alkyldiphenylamine, and N-nitrodiphenylamine and/or 0.001 to 10 weight % of at least one corrosion inhibitor selected from the group consisting of benzotriazole, imidazoline, pyrimidine derivative, 1,3,4-thiadiazole polysulfide, 1,3,4-thiadiazorile-2,5-bis-dialkyl dithiocarbamate, 2-(alkyldithio)-benzoimidazole, β-(o-carboxybenzylthio)-propionnitrile and propionic acid.

4. An electroviscous fluid in which no moisture is contained comprising an electrically insulating fluid with viscosity of 5 to 300 cp at 40° C. as a dispersion medium, and dispersed therein:

(a) 0.1 to 50 weight % of porous solid particles;

(b) 1 to 30 weight %, based on the porous solid particles, of at least one polyhydric alcohol selected from the group consisting of ethylene glycol, triethylene glycol, glycerine, propanediol, butanediol, and hexanediol;

(c) 0.01 to 5 weight % of at least one substance selected from the group consisting of sulfuric acid, hydrochloric acid, nitric acid, perchloric acid, chromic acid, phosphoric acid, boric acid, acetic acid, formic acid, propionic acid, lactic acid, isolactic acid, valeric acid, oxalic acid, malonic acid, lithium chloride, sodium chloride, potassium chloride, magnesium chloride, calcium chloride, barium chloride, lithium bromide, sodium bromide, potassium bromide, magnesium bromide, lithium iodide, sodium iodide, potassium iodide, silver nitrate, calcium nitrate, sodium nitrite, ammonium nitrate, potassium sulfate, sodium sulfate, sodium hydrogensulfate, ammonium sulfate, formic acid salt, acetic acid salt, oxalic acid salt, succinic acid salt, sodium hydroxide, potassium hydroxide, calcium hydroxide, sodium carbonate, sodium hydrogencarbonate, potassium phosphate, aniline, alkylamine, and ethanolamine;

(d) 0.1 to 10 weight % of at least one dispersing agent selected from the group consisting of magnesium sulfonate, calcium sulfonate, calcium phosphonate, polybutenyl succinimide, and sorbitan monooleate; and (d) 0.1 to 10 weight % of at least one antioxidant selected from the group consisting of 2,6-di-t-butylparacresol, 4,4'-methylene-bis-(2,6-di-ti-butylphenol), 2,6-di-t-butylphenol, dioctyldiphenylamine, phenyl-α-naphthylamine, alkyldiphenylamine, and N-nitrodiphenylamine and/or 0.001 to 10 weight % of at least one corrosion inhibitor selected from the group consisting of benzotriazole, imidazoline, pyrimidine derivative, 1,3,4-thiadiazole polysulfide, 1,3,4-thiadiazorile-2,5-bis-dialkyl dithiocarbamate, 2-(alkyldithio)-benzoimidazole, β-(o-carboxybenzylthio)-propionnitrile and propionic acid.

* * * * *